United States Patent [19]

Emrick

[11] 4,250,592

[45] Feb. 17, 1981

[54] VACUUM CLEANER

[76] Inventor: Donald G. Emrick, 541 Holly La., Plantation, Fla. 33317

[21] Appl. No.: 73,505

[22] Filed: Sep. 7, 1979

Related U.S. Application Data

[63] Continuation of Ser. No. 842,540, Oct. 17, 1977, abandoned.

[51] Int. Cl.[3] ..... A47L 11/30

[52] U.S. Cl. ..... 15/320; 15/353; 15/366

[58] Field of Search ..... 15/91, 92, 308, 309, 15/320, 321, 353, 366, 386

[56] References Cited

U.S. PATENT DOCUMENTS

| | | | |
|---|---|---|---|
| 1,075,042 | 10/1913 | Kosminski | 15/92 |
| 2,233,167 | 2/1941 | Holm-Hansen | 15/353 |
| 2,306,212 | 12/1942 | Gerstmann | 15/353 X |
| 2,333,829 | 11/1943 | Terry | 15/320 |
| 2,735,125 | 2/1956 | Erbs | 15/320 X |
| 3,392,418 | 7/1968 | Schowalter | 15/320 |
| 3,606,631 | 9/1971 | Vassh | 15/353 X |
| 4,167,798 | 9/1979 | Klugl et al. | 15/320 |

*Primary Examiner*—Christopher K. Moore

*Attorney, Agent, or Firm*—Malin & Haley

[57] ABSTRACT

A new and improved home-commercial floor covering vacuum cleaning and liquid cleaning apparatus employing a rotating beater disposed within a vacuum-liquid cleaning chamber. The beater vibrates the floor covering by striking the flooring surface to agitate the dirt which is then moved by a vacuum system into a removable collecting chamber. When the dirt laden air enters the liquid collecting chamber of the apparatus, the dirt impinges on the surface of the collecting liquid and is thereby deposited in the liquid while the dirt-free air is again moved through the blower. The blower exit provides a stream of air into the vacuum-liquid cleaning chamber to pick up additional dirt. A quantity of foam-type cleaning solution is available from a container for periodical release into the stream of air exiting the blower to provide foam on the floor surface adjacent the beater. The foam is picked up by the vacuum system adjacent the rotating beaters to remove surface soil and stains. The mixture of air, foam cleaning solution and dirt particles and stain materials is exhausted from the vacuum-liquid cleaning chamber into the liquid collecting chamber where the laden air is de-foamed and cleaned so that the air may be again recycled by the blower.

3 Claims, 7 Drawing Figures

VACUUM CLEANER

This is a continuation of Application Ser. No. 842,540, filed Oct. 17, 1977, now abandoned.

BACKGROUND OF THE INVENTION

The present invention relates to an improved home-commercial vacuum type floor cleaner, and more particularly to an improved cleaning device for use with a vacuum system whereby a plurality of rotating beater devices agitate and vibrate the dirt to the surface of the floor covering or carpet for initial removal by the vacuum system and a foam-type cleaning solution system that is periodically sprayed upon the carpet for similar agitation by the rotating beater device for further cleaning purposes to remove the surface soil. The dirt and/or cleaning solution entrained in the air that is drawn off the carpet is discharged into a removable liquid collecting chamber containing a collection liquid. The dirt and foam cleaning solution are deposited in the collecting liquid while the clean air is available for recycling.

Various types of devices have been used for spraying a cleaning solution on a soiled carpet and then removing the solution by a vacuum means. One such device is shown in the Burgoon apparatus, U.S. Pat. No. 3,964,925. This type of apparatus must use a separate large volume chamber in order to allow a substantial decrease in the air velocity so that the air-borne particles will drop out. This type of device is obviously more expensive and complex than the applicant's unitary system.

An additional disadvantage of prior vacuuming and cleaning means is that the cleaning air is recirculated to the carpet without providing a positive means for removing the entrained dirt and foam cleaning solution from the exhaust air.

A further disadvantage of the present methods of cleaning carpets is that a substantial back pressure is created in the dirt and cleaning solution collecting chamber thus decreasing the available vacuum force used to remove the dirt and liquid cleaning solution from the carpet.

SUMMARY OF THE INVENTION

A new and improved home-commercial floor covering apparatus for vacuuming and liquid cleaning of carpets that employ a rotating beater disposed within a vacuum-liquid cleaning chamber. The beater strikes the flooring surface and agitates the dirt which is then moved by the vacuum system. The vacuum system includes a motor driven blower that transfers the collected material and deposits the same into removable collecting chamber containing a liquid. When the dirt laden air enters the liquid collecting chamber, the dirt impinges on the surface of the liquid and is thereby deposited in the liquid while the dirt-free air is again directed by the blower into the vacuum chamber to pick up additional dirt. The incoming air stirs the liquid in the liquid collector chamber to increase turbulence therein in order to aid in cleaning the air passing through the liquid collecting chamber. A foam type cleaning solution is periodically released into and mixed with the air exiting the blower by the operator The foam and air is directed into the vacuum-liquid cleaning chamber where in conjunction with the action of the rotating beaters. The surface soil and stains are removed. The beating means may also include floppy wiping means. Again, the mixture of air, foam cleaning solution and soil is exhausted from the vacuum-liquid cleaning chamber into the liquid collecting chamber containing liquid where the soil and foam cleaning solution is de-foamed and deposited in the liquid to provide recyclable air.

The present invention affords a solution to the problems mentioned above by providing a compact cleaner of unitary construction.

It is an object of this device to provide a vacuum cleaner, foam cleaner, a carpet vibrator, and an air return cleaning means in a single noncomplex unit.

It is therefore another object of this invention to provide means for removing embedded dirt from deep within the carpet pile by beating the carpet to agitate and vibrate the dirt while removing the agitated dirt with a vacuum means.

Another object of this invention is to provide a means for entrapping the removed dirt in a liquid to prevent the return of the dirt to the just cleaned carpet or to the surrounding atmosphere.

Still another object of the present invention is to provide a removable bucket type liquid collecting chamber tht is easily removed, cleaned and replaced for further use.

A further object of the present invention is to provide a liquid collecting chamber means for supplying the clean exhaust air from a vacuum-liquid cleaning apparatus.

Still another object of the present invention is to remove the used foam cleaning solution with its entrapped dirt from the carpet by the same means as the dry dirt laden air is removed from the carpet in a unitary machine.

A still further object of this invention is to provide a means for extracting the dirt and cleaning solution from the air mixture without restricting the air flow.

Another object of the present invention is to replace the rotating beaters with brush-type agitators for use on generally smooth hard surfaces.

Another object is to provide a relatively light weight commercial type device that is easily transported on a movable push handle.

Another object is to provide a commercial type device that is easily moved back and forth over the carpet, and that provides an observation means to see the dirt being removed from a carpet, and that is easily serviced.

Another object is to provide a commercial type device that is easy to use in completely cleaning carpets.

Another object is to provide a two hand handle that must be pushed in front of the operator to slow the speed of the apparatus over the carpet to insure proper cleaning.

In accordance with these and other objects which will be apparent hereinafter, the instant invention will now be described with particular reference to the accompanying drawings.

DESCRIPTION OF THE PREFERRED EMBODIMENTS

Figure 1:
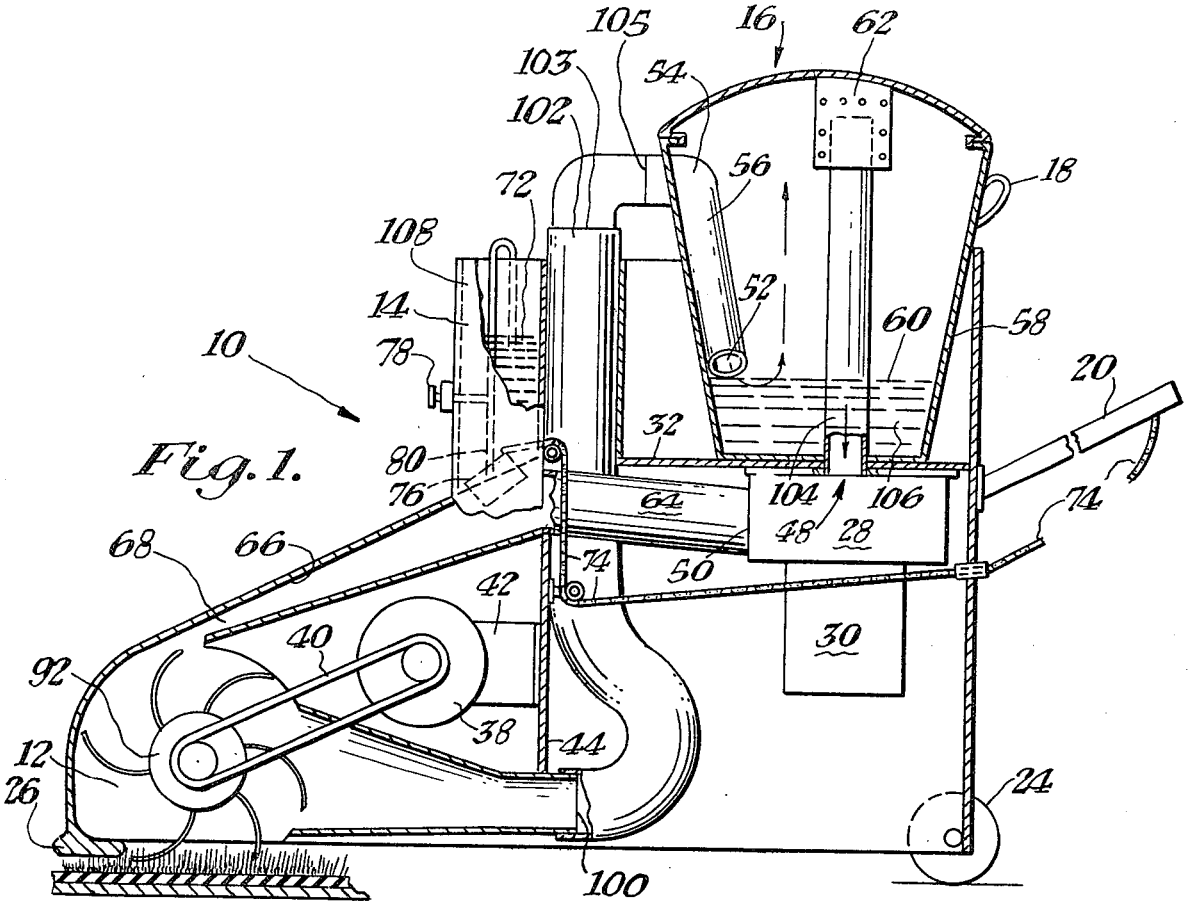
FIG. 1 is a side view of the device with the side walls broken away to show the components.
Figure 3:
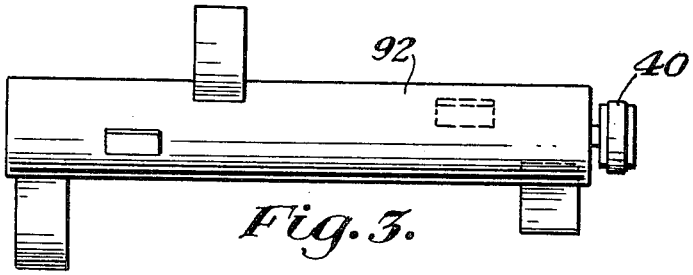
FIG. 3 is a top view of the beater.

The improved home and commercial floor covering vacuuming and cleaning apparatus shown in FIG. 1. The apparatus 10 comprises a unitary body including a beating means housing 12, a liquid cleaning solution dispenser 14 and a liquid collecting means housing 16 having a pivotable handle means 18 for removing the container, a push handle 20 or handle 21 with a carrying means 22 shown in FIG. 6. and a rear wheel 24 shown in FIGS. 1 and 6 and a front slide plate 26 which guide the apparatus over the floor to be cleaned.

Within the apparatus 10 is vacuum blower 28 and motor 30 such as a number 115880 by Lamb Electric (powered by an electrical motor means 30 which may be a P-CL 5140, F701 by General Electric). The blower 28 and motor means 30 are supported by a mounting plate 32 connected to side walls 34, a rotatable beating means 92 supported by sidewalls 34 is in communication with a drive motor 38 by belt 40. The motor 38 may be a General Electric P-CL 5140, F701, and is supported by bracket 42 and attached to plate 44 connected to the sidewalls 34. The cleaning solution holding means 14 and the removable dirt filtering and collecting means 16 are mounted on the upper cover member 46.

The vacuum blower 28 has a suction inlet 48 and an exit 50. The inlet is in communication through a discharge means 52 with the proximal end 54 of a conduit 56 positioned within the removable dirt collector bucket 58. The distal end 52 of the conduit 56 at the liquid level 60 is open to atmospheric pressure within said dirt collector 16. The exit conduit 104 is covered by a screen or filtering means 62 connected to the inlet to prevent the foam from being drawn into the blower 28.

Figure 2:
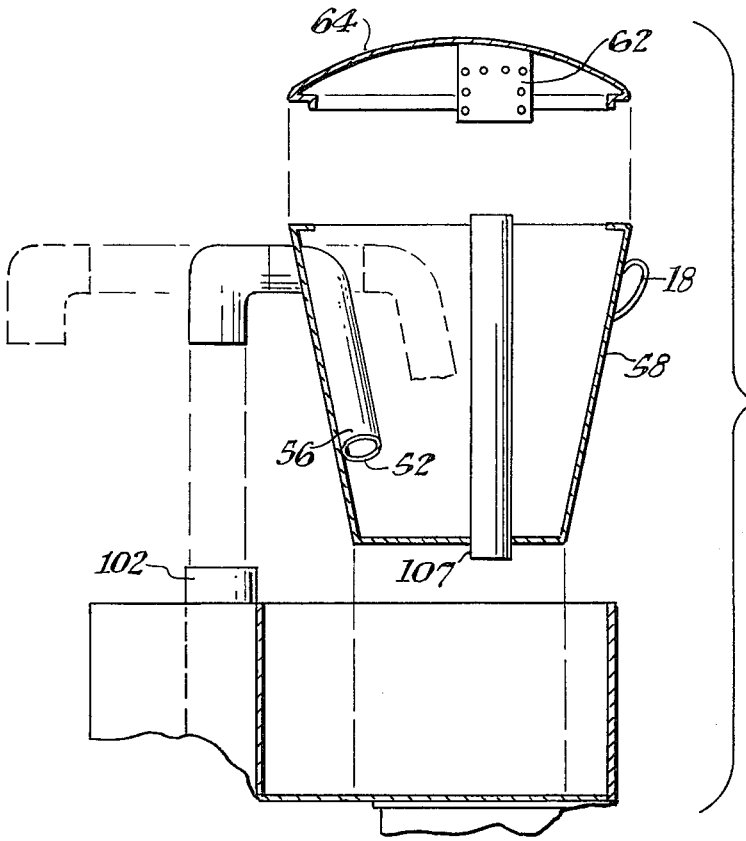
FIG. 2 is an exploded sectional view of the liquid cleaning compartment.

The bucket is removable by the use of an ordinary bucket handle 18, as shown in FIG. 2. The cover 64 is also removable to allow the user to fill and empty the bucket 58.

Figure 5:
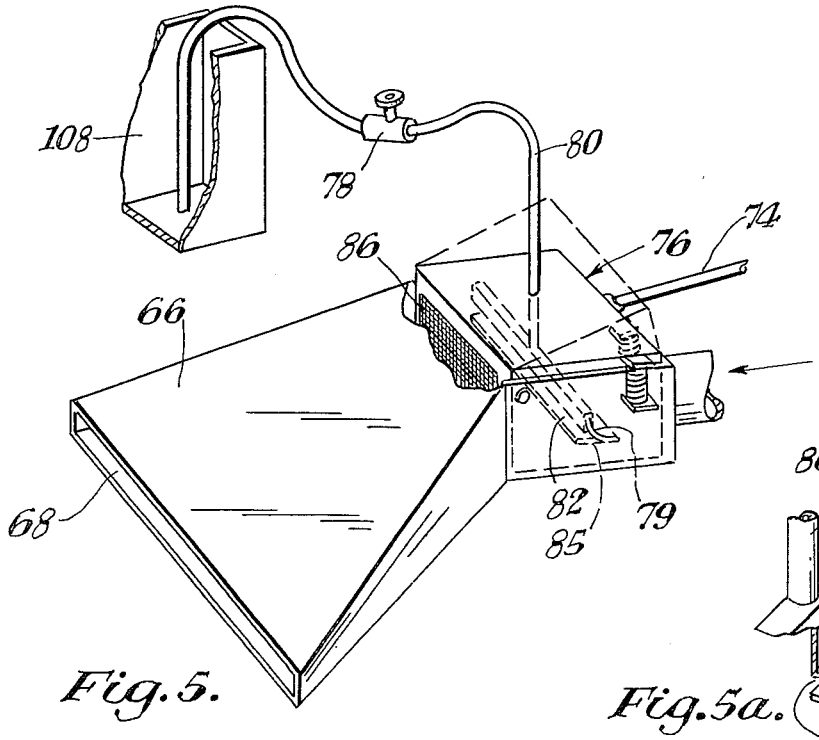
FIG. 5 is an illustration of the foaming apparatus and cleaning liquid container.
Figure 5A:
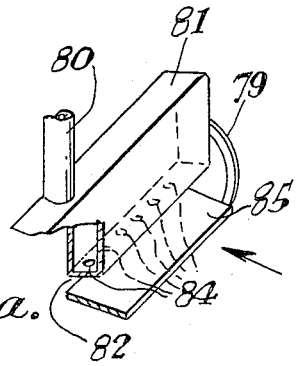
FIG. 5*a* is an illustration of the cleaning liquid dispenser partially broken away.

The discharge outlet 50 of said blower 28 is connected through a conduit 64 to a manifold 66 within housing cavity. The manifold 66 distributes the air from the blower 28 onto the surface to be cleaned. The manifold discharge end 68 may be extended as shown at 70 in FIG. 6. The air may be mixed with cleaning solution 72 in a container. The cleaning solution is mixed in the manifold 66 when operator operates control linkage 74 and opens valve 78. when control linkage 74 is operated the foaming member 76 moves down from a storage position out of the normal air stream of the manifold 66 as shown in FIG. 5 and when valve 78 is opened, as shown in FIGS. 1 and 5, the liquid 72 will move through conduit 80 by a siphoning action. The cleaning solution liquid flows into the conduit 80 when the air moves through venturi 82. The increased velocity of air below openings 84 in the nozzle 81 draws the cleaning solution out of openings 84. The plate 85 is a venturi vane connected to nozzle 81 through member 79 as shown in FIG. 5*a*. Member 79 is connected to foaming member 76 and moves with the foaming member 76 when linkage 74 is operated. The liquid moves into the air and contacts the screen 86 which aids in foaming the liquid cleaning solution. The foam moves through the manifold 66 onto the surface to be cleaned.

The rotatable beating means 92 mounted between opposite end walls 34 of said housing has outwardly extending somewhat stiff flexible finger-like agitators 88 radially protruding therefrom. The beater fingers 88 protrude through aperture 90 on the drum 92 to contact the floor surface to be cleaned. The distal end of agitator 88 is illustrated by number 96. The agitators 88 strike the carpet to cause dirt which is embedded deep within the carpet to move upward to the surface where it may be entrained in the air flowing through the housing 12. The agitators 88 vibrate the carpet and may be weighted at the distal end 96 for increased activity. Floppy wiping means 98 may be connected to the drum to help clean the carpet when foam is being applied.

The discharge from the housing cavity 12 is drawn through a passage 100 which is in communication with a conduit 102 connecting the passage 100 with an inlet opening 54 of the conduit 56 in the liquid dirt collector 16. The liquid dirt collector 16 may be removed from the device for cleaning. Conduit 56 is disconnected at 103 or 105 and conduit 104 is disconnected at 107 from the blower 28.

Connected within the liquid dirt collector 16 is the downwardly disposed conduit 56 having its distal end 52 at an angle at the liquid surface level 60. The angular discharge of the air, etc. onto the surface 60 assists in stirring the liquid to aid in the removal of dirt and reduces back pressure. Splashing of the liquid will aid in removing the dirt from the incoming air.

The upper porton of the collector 16 about filter 62 is a vacuum. The vacuum is created by the blower 28 driven by motor 30.

In the operation of the system described, initially the cleaning apparatus is used without cleaning solution to remove deeply embedded dirt and debris from within the carpet. With the liquid level just below the distal end 52 of the inlet conduit 56, the device is energized such that the vacuum blower 28 discharges an air stream through conduit 64 and manifold 66 into housing cavity 12 whereupon the discharged air stream is entrained with dirt particles which have been agitated by the rotating beating means 92. Since the pressure at the inlet aperture 54 to the dirt collector 16 is less than atmospheric, the dirt laden air is drawn into the dirt collector bucket 58 through the conduit 54 and when it strikes the surface 60 of the liquid 106 it is trapped in the liquid 106. The dirt free air then travels to the upper portion of the dirt collecting bucket 58 and through the screen or filter 62 and conduit 104 back into the suction side of the vacuum blower 28 to be cycled again through the device.

After the maximum amount of dirt has been removed by the above mentioned dry vacuum method with the beater 92 in operation, the removal of surface soil and stains may be accomplished with a cleaning solution. The cleaning solution 72 is discharged from said cleaning solution holder 108 into the conduit 80 where it flows out of a plurality of openings 84 in nozzle 81. The venturi vane 85 connected by member 79 to the nozzle 81 draws the fluid out of tank 108 as controlled by valve 78 after the foaming member 76 is placed in the air flow by operating control link 74 which is, for example, a flexible cable having one end connected to the foaming member 76 as shown in FIGS. 1 and 5. The fluid mixes with the air stream flowing through screen 86, foams and moves through a conduit onto the surface to be cleaned. The cleaning solution may be released from the holder 108 by operating the linkage 74 and adjusting the discharge valve 78. The cleaning solution air mixture is then distributed over the surface to be cleaned where the solution is worked onto the surface by said rotating finger-like agitators, thus creating a mixture of dirt, cleaning solution and air. This last mentioned mixture is then drawn into the dirt collecting means and is discharged through said conduit 64 and into the liquid 106 whereupon the cleaning solution and dirt are retained in the liquid 106 but the clean air again returns to the suction side of the vacuum blower 28 for recirculation. The top 64 is a clear material so a user pushing handle 20 can view the work being done.

Figure 6:
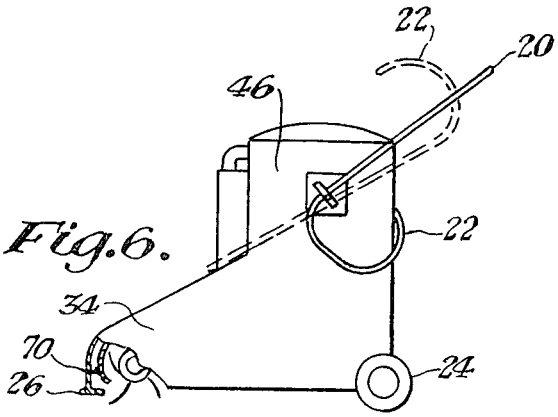
FIG. 6 is a side view of the device with a portion of the side broken away showing another embodiment of the blower output channel.
Figure 4:
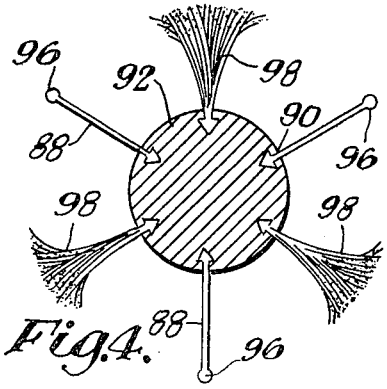
FIG. 4 is an end view of another embodiment of the beater.

Handle 21 in FIG. 6 may be adjusted by releasing wing nut 112. The carrying handle 22 may be adjusted over the member 16.

The instant invention has shown and described herein in what is considered to be the most practical and preferred embodiment. It is recognized, however, that departures may be made therefrom within the scope of the invention and that obvious modifications will occur to a person skilled in the art.

What I claim is:

1. A floor covering vacuuming and cleaning apparatus comprising:

a housing defining a cavity with a transverse opening juxtapositioned to said floor covering, said cavity having inlet and outlet conduits connected thereto, said outlet conduit having a lower pressure than said inlet conduit, a rotatable generally cylindrical beating means mounted between opposite end wall portions of said housing, said beating means protruding from said opening for contacting said floor covering, said beating means includes a plurality of transverse alternate rows of arcuate finger like straps and broom-like wipers for striking the surface to be cleaned, a power means connected to said rotatable beating means for moving said beating means about a generally horizontal axis, a dirt collecting means partially filled with liquid, said collecting means having an inlet conduit connected to said housing outlet conduit and an outlet conduit connected to a low pressure suction of said pressure producing means, a higher pressure discharge of said pressure producing means connected to said housing inlet conduit, a cleaning solution holding means mounted in connectable contact with said housing inlet conduit for storing a cleaning solution to be foamed and used on said floor covering, directing said foam through said inlet conduit into said housing for removal of surface dirt, and a cleaning solution dispensing and foaming means fluidly connected to said cleaning solution holding means for discharging cleaning solution into said housing inlet conduit for foaming for discharge of foam upon said floor covering to be cleaned.

2. An apparatus, as in claim 1, wherein:

said dirt collecting means is partially filled with water and includes a first conduit having a discharge outlet spaced near the surface of said water for impingement on said water by the discharge of said first conduit whereby the dirt and liquid in said first conduit is separated from the fluid drawn into said dirt collecting means by the suction of said pressure producing means, said dirt collection means further including a second conduit through which the separated air is drawn into the suction of said pressure producing means after dirt and liquid has been removed from the fluid flowing through said first conduit.

3. An apparatus, as in claim 1, wherein:

said cleaning solution holding means includes a reservoir whereby said cleaning solution is discharged therefrom through said dispensing and foaming means for discharging foamed cleaning solution for use on said surface to be cleaned.

* * * * *